United States Patent [19]

Kozima et al.

[11] 4,264,695

[45] Apr. 28, 1981

[54] ELECTROPHOTOGRAPHIC PHOTOSENSITIVE MATERIAL WITH ELECTRON DONORS AND ELECTRON ACCEPTORS

[75] Inventors: Akio Kozima; Mitsuru Hashimoto; Masafumi Ohta; Masaomi Sasaki; Zenjiro Okuno, all of Tokyo, Japan

[73] Assignee: Ricoh Co., Ltd., Tokyo, Japan

[21] Appl. No.: 116,188

[22] Filed: Jan. 28, 1980

Related U.S. Application Data

[63] Continuation of Ser. No. 825,229, Aug. 17, 1977, abandoned.

[30] Foreign Application Priority Data

Aug. 23, 1976 [JP] Japan ..... 51-100369

[51] Int. Cl.[3] ..... G03G 5/09; G03G 5/14; G03G 5/04

[52] U.S. Cl. ..... 430/58; 430/81; 430/83; 430/95; 430/900

[58] Field of Search ..... 430/58, 59, 81, 83, 430/95, 900

[56] References Cited

U.S. PATENT DOCUMENTS

| | | | |
|---|---|---|---|
| 3,287,114 | 11/1966 | Hoegl . | |
| 3,877,935 | 4/1975 | Regensburger . | |
| 3,895,944 | 7/1975 | Wiedemann et al. . | |
| 3,997,342 | 12/1976 | Bailey . | |
| 4,018,602 | 4/1977 | Chu . | |
| 4,106,934 | 8/1978 | Turnblom | 430/900 X |

OTHER PUBLICATIONS

Berwick et al., "Multi-active Photoconductive Element", Res. Discl., May 1975, pp. 38–43.

*Primary Examiner*—Roland E. Martin, Jr.
*Attorney, Agent, or Firm*—Blanchard, Flynn, Thiel, Boutell & Tanis

[57] ABSTRACT

A photosensitive material for use in electrophotography which comprises a conductive support, a first layer consisting essentially of a substance capable of generating a conductive carrier through light absorption and an electron donor or an electron acceptor, and a second layer consisting essentially of an electron acceptor or an electron donor, to wit, a substance constituting the opposite party of the electron donor or the electron acceptor contained in the first layer, said first and second layers being formed in that order on said conductive support.

9 Claims, No Drawings

ELECTROPHOTOGRAPHIC PHOTOSENSITIVE MATERIAL WITH ELECTRON DONORS AND ELECTRON ACCEPTORS

This is a continuation of application Ser. No. 825,229, filed Aug. 17, 1977, now abandoned.

BACKGROUND OF THE INVENTION (a) Field of the Invention

The present invention relates to a laminate type photosensitive material for use in electrophotography.

(b) Description of the Prior Art

As the photosensitive material for use in electrophotography, there have hitherto been known the so-called dispersion-type photosensitive material prepared by coating a dispersion obtained by dispersing a relatively large quantity of inorganic photoconductive substance such as zinc oxide, titanium oxide, cadmium sulfide, etc. in an appropriate binder on a conductive support, the so-called evaporative-type photosensitive material prepared by depositing an inorganic photoconductive substance such as selenium, selenium alloy, etc. through vacuum evaporation on a conductive support, and the organic photosensitive material prepared by coating an organic photoconductive substance such as poly-N-vinyl carbazole or derivatives thereof, and derivatives of polyphenylene pyrazole, polyvinyl anthracene, polyvinyl pyrene, oxazole, oxadiazole, pyrazole or imidazole, anthracene, tetraphene, pyrene, etc. on a conductive support.

However, the dispersion-type photosensitive material is defective in that it is inferior in surface smoothness and mechanical strength due to its large content of inorganic photoconductive substance. The evaporation-type photosensitive material is defective in that the cost of manufacturing thereof is high and the stability of the photoconductive substance used therein is questionable. And, as to the organic photosensitive material, although it is admittedly superior to the foregoing dispersion-type photosensitive material and evaporative-type photosensitive material in flexibility, light transmissibility, etc., it is defective in that the practical electrophotographic sensitivity thereof is generally poor and therefore it is still unsuitable for extensive use.

With a view to improving the foregoing defects of the conventional photosensitive materials, a variety of the so-called laminate-type photosensitive materials for use in electrophotography have recently been proposed. These laminate-type photosensitive materials can be classified broadly into 3 types. Photosensitive materials of the first type include ones prepared by interposing a barrier layer consisting essentially of metal oxide, polyamide, polyurethane, acrylic resin, polystyrene or the like in between a support and a photoconductive layer in order to control the dark decay and ones prepared by forming an adhesive layer consisting essentially of polyamide, polyester, vinyl acetate resin, cellulose type resin, polyvinyl alcohol or the like in order to improve the adhesion between a support and a photoconductive layer or forming a protective layer consisting of a resin such as cellulose-type resin, polyvinyl acetal, silicone resin, polyester, vinyl chloride resin, vinyl acetate resin, polystyrene, acrylic resin, polyamide or the like on the photoconductive layer (the latter ones are also useful in the modified processes of NP, PIP, polarity reversing process, etc. other than Carlson's type process). Photosensitive materials of the second type include ones prepared by forming a resin layer as an electrically insulating layer which consists essentially of polyethylene terephthalate, polytetrafluoroethylene, cellulose acetate, polyacrylonitrile, polyamide, polyvinyl carbazole or the like on a photoconductive layer as disclosed in the Japanese Patent Publication No. 11787/1966, No. 23910/1967, No. 2965/1973, etc. (photosensitive materials of this type are utilized exclusively for complicated modified processes other than Carlson's process). The photosensitive materials of the third type include ones prepared by forming a layer for transporting conductive carriers generated within a photoconductive layer through light absorption on said photoconductive layer as disclosed in the Japanese Patent Publication No. 16198/1967, No. 5349/1970, etc. However, in the case of photosensitive materials of the first and second types, although the physical properties thereof such as the surface smoothness, adhesive property, etc. and/or flexibility admittedly improve to some extent, the electrophotographic sensitivity thereof deteriorates. Besides, in the case of the photosensitive materials of the second type, inasmuch as a more complex electrophotographic process is applied thereto, the cost of copies becomes higher. In the case of photosensitive materials of the third type, the interlayer adhesion is poor and an electric charge barrier is apt to be brought about on the interface between the photoconductive layer and the conductive carrier layer. Accordingly, when they are used repeatedly, there occur deterioration of the properties, fatigue phenomenon, residual potential, etc. and it gradually becomes impossible to form a clear-cut image.

SUMMARY OF THE INVENTION

A principal object of the present invention is to eliminate all of the foregoing drawbacks of the prior art, and to provide a novel photosensitive material for use in electrophotography which has the advantages of the photosensitive materials of said first or second type, is easy to manufacture notwithstanding it is of the laminate type, does not require a complicated electrophotographic process, and nevertheless can form a clear-cut image.

Another object of the present invention is to provide a novel photosensitive material with high sensitivity for use in electrophotography which is suitable for repeated use.

A photosensitive material as set forth above is one comprising a conductive support, a first layer consisting essentially of a substance capable of generating a conductive carrier through light absorption and an electron donor or an electron acceptor, and a second layer consisting essentially of an electron acceptor or an electron donor, to wit, a substance consituting the opposite party of the electron donor or the electron acceptor contained in the first layer, said first layer and second layer being formed in succession on said conductive support.

In other words, the present invention can assume the following two modes.

The first mode of the invention is an electrophotographic sensitive material comprising a conductive support, a first layer consisting essentially of a substance capable of generating a conductive carrier through light absorption and an electron donor (hereinafter referred to as 'the layer A'), and a second layer consisting essentially of an electron acceptor (hereinafter referred to as 'the layer B') said first layer and second layer being formed in the order on said conductive support.

The second mode of the invention is an electrophotographic sensitive material comprising a conductive support, a first layer consisting essentially of a substance capable of generating a conductive carrier through light absorption and an electron acceptor (hereinafter referred to as 'the layer C'), and a second layer consisting essentially of an electron donor (hereinafter referred to as 'the layer D'), said first layer and second layer being formed in that order on said conductive support.

DETAILED DESCRIPTION OF THE INVENTION

In the present invention, as the substance capable of generating a conductive carrier through light absorption which is to be contained in said layer A or layer C, inorganic photoconductive substance like Se, Se alloy, CdS, CdSe, ZnO, ZnS, TiO etc., and organic photoconductive pigments like phthalocyanine pigment, azo pigment, indigo pigment, perylene pigment, polycyclic quinone pigment, etc. are useful.

As the electron donor to be contained in said layer A or layer D, poly-N-vinyl carbazole and derivatives thereof, poly-γ-carbazolyl ethyl glutamate and derivatives thereof, purene-formaldehyde condensate and derivatives thereof, anthracene-formaldehyde condensate, N-ethyl carbazole-formaldehyde condensate, polyphenine pyrazole, poly-1-allyl-4,5-diphenyl imidazole, polyvinyl pyrene, polyvinyl phenanthrene, polyacenaphthylene, polyvinyl dibenzothiophene, polyvinyl anthracene, oxazole, oxadiazole, pyrazole, imidazole derivatives, anthracene, tetraphene, pyrene, etc. are useful.

And, as the electron acceptor to be contained in said layer B or layer C, fluorenone derivatives, dibenzothiophene derivatives, indenothiophene derivatives, phenanthrene quinone derivatives, indenopyridine derivatives, thioxanthone derivatives, benzo[C]cinnoline derivatives, phenazine oxide derivatives, tetracyanoethylene, tetracyanoquinodimethane, bromanil, chloranil, benzoquinone, naphthoquinone, anthraquinone derivatives, phthalic anhydride, picric acid, trichloroacetic acid, etc. can be cited.

In addition to the above, those substances which have been disclosed in Electrophotograph 5, 19(1964), namely, tetrabromonaphthoquinone, etc. and those substances which have been disclosed in J. Phys. Chem. 69, 755(1965), namely, 1,5-dinitronaphthalene, 2,4,5,7-tetranitrofluorenone, 1,4-dibromonaphthalene, pyrene-3-aldehyde, 9-acetylanthracene, etc. are also useful as the electron acceptor.

The layer A or layer C contains at least one kind of substances capable of generating a conductive carrier through light absorption, and the appropriate ratio of the conductive carrier generating substance to the electron donor or acceptor is in the range of 1:10–1:0.1, preferably 1:2–1:0.5, by weight. And, the first layer may contain some resinous binder and/or plasticizer as occasion demands. In the case where a resinous binder and/or a plasticizer are used jointly in the first layer, the appropriate amount of said resinous binder and/or plasticizer is less than 200 wt.%, preferably less than 100 wt.%, relative to the total amount of the conductive carrier generating substance and the electron donor or the electron acceptor.

As the applicable resinous binder, there are polyester, polycarbonate, polystyrene, polyvinyl methacrylate, polyvinyl acrylate, polyvinyl acetate, polyvinyl chloride, polyamide, polyurethane, silicone resin, alkyd resin, epoxide resin, cellulose type resin, etc., and as the plasticizer, those which are generally used in the field of plastics are all applicable. The appropriate thickness of the first layer is in the range of 0.05–20μ, preferably 0.1–5μ.

Besides, in the second layer too, a resinous binder and a plasticizer may be used jointly. As the resinous binder for use in the second layer, those resins applicable to the first layer are all useful, and as for the plasticizer, those which are generally used in the field of plastics are all applicable. The appropriate amount of said resinous binder and/or plasticizer to be contained in the second layer is less than 200 wt.%, preferably less than 100 wt.%, relative to the amount of the electron donor or the electron acceptor. And, the thickness of the first second layer is preferably in the range of 5–100μ.

The electrophotographic sensitive material in the present invention is manufactured by the conventional coating method. That is, it will do to coat a solution or a dispersion of materials to form the first layer on a conductive support such as metal plate, metal laminated paper (or film), etc. and thereafter coat a solution or a dispersion of materials to form the second layer on said first layer. However, as the solvent to be employed for the solution or dispersion of materials to form the layer B or layer D, one capable of dissolving the electron acceptor or the electron donor of the layer A or layer C is desirable.

In the photosensitive material according to the present invention the foregoing first layer and second layer are indispensable constituents but with a view to further improving the adhesive property and electrification characteristic of the photosensitive material without impairing the advantages of the present invention, it is feasible to provide a layer of resin such as polyamide, vinyl acetate resin, polyurethane, etc. or a layer of metal oxide such as aluminum oxide having a thickness in the range of about 0.01–1.0μ in between the conductive support and the first layer.

In the photosensitive material of the present invention having a constitution as set forth above, inasmuch a substance capable of generating a conductive carrier through light absorption is contained in the first layer, it is likely that as a result of a reaction between the electron donor or the electron acceptor contained in the first layer and the electron donor or the electron acceptor contained in the second layer, a charge-transport type complex is formed on the interface between these layers whereby the amount of a conductive carrier generated through light absorption increases and the sensitivity improves remarkably. Further, depending on the combination of the electron acceptor and the electron donor, it is feasible to form a charge-transport type complex having an absorption region different from the absorption region of the conductive carrier generating substance contained in the first layer, and a superior panchromatic electrophotographic sensitive material is also feasible.

Moreover, although particulars are yet to be clarified, inasmuch as a charge-transport type complex is formed on the interface between the first layer and the second layer, the interfacial barrier is eliminated and the residual potential decreases, so that there can be obtained a clear-cut image free of stains on the ground thereof even when the photosensitive material is used repeatedly.

It has been found that adoption of the layer constitution according to the present invention much improves the uniform chargeability of electricity as well as holding thereof and provides an image of high concentration.

In this context, as the copying method apposite to the photosensitive material of the present invention, Carlson's process is adopted.

DESCRIPTION OF PREFERRED EMBODIMENTS

EXAMPLE 1

By applying coating liquids for the layer A and for the layer B according to the following prescriptions, respectively, on a polyester film coated with aluminum by the use of a doctor blade, a laminate type electrophotographic sensitive material was prepared.

Coating liquid for layer A:

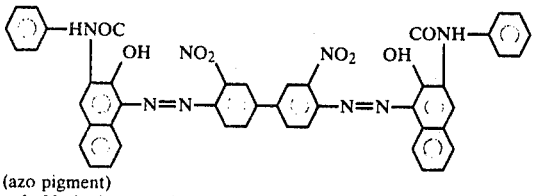

| | |
|---|---|
| (azo pigment) | 1 g |
| poly-N-vinyl carbazole | 1 g |
| polyester resin | |
| (Polyester adhesive 4900, a product of DuPont Inc.) | 0.1 g |
| tetrahydrofuran | 100 g |

Coating liquid for layer B:

| | |
|---|---|
| 2,4,8-trinitrothioxanthone | 5 g |
| polyester resin (the same as in layer A) | 5 g |
| tetrahydrofuran | 100 g |

The thus obtained photosensitive material was then electrified by 20 seconds' corona discharge of +6.0 KV, left standing in a dark place for 20 seconds thereafter and measured about the surface potential $V_{po}$ (V) thereat. Subsequently, the amount of exposure $E_{\frac{1}{2}}$ (lux.-sec) required for half decay of $V_{po}$ after application of the light of a 20-lux white tungsten lamp, to wit, the sensitivity, was measured. $V_{po}$ and $E_{\frac{1}{2}}$ of this photosensitive material were 1050 V and 3.0 lux.sec. respectively. Next, when an electrostatic latent image was formed by effecting electrification and image-like exposure by the known method, the thus formed latent image was subjected to dry developing or wet developing, and the resulting toner image was electrostatically transferred onto a slick paper and fixed thereon, there was obtained a positive image free of stains on the ground thereof and faithful to the original.

EXAMPLE 2

By applying the same procedure as in Example 1 except for the use of a coating liquid for the layer A and for the layer B according to the following prescription, respectively, a laminate type electrophotographic sensitive material was prepared.

Coating liquid for layer A:

Dian Blue: 1 g
3-nitropyrene-formaldehyde condensate: 1 g
polyester resin (the same as in Example 1): 0.1 g
tetrahydrofuran: 100 g Coating liquid for layer B:

2,6,8-trinitro-4H-indeno[1,2-b]thiophene-4-on: 5 g
polyester resin (the same as in Example 1): 5 g
tetrahydrofuran: 100 g $V_{po}$ and $E_{\frac{1}{2}}$ of the thus prepared photosensitive material were 900 V and 3.5 lux.sec., respectively. And, when this photosensitive material was used in copying through the same procedure as in Example 1, the result was as satisfactory as in Example 1.

EXAMPLE 3

By applying a coating liquid according to the following prescription as dispersed thoroughly by means of a ball mill on a polyester film deposited with aluminum through vacuum evaporation by the use of a doctor blade, the layer C having a dry thickness of 1.5μ was formed thereon.

B-type copper phthalocyanine (namely, SUMITOMO Cyanine Blue LBG, the manufacture of SUMITOMO KAGAKU K.K.): 1 g
2,4,7-trinitro-9-fluorenone: 1 g
tetrahydrofuran: 100 g Next, a coating liquid according to the following prescription was applied onto the foregoing layer C by means of a doctor blade to form the layer D having a dry thickness of 10.5μ, whereby a laminate-type electrophotographic sensitive material was prepared.

poly-N-vinyl carbazole (namely, Luvican M-170, the manufacture of BASF): 10 g
polyester resin (namely, Polyester Adhesive 4900, the manufacture of Du Pont Inc.): 1 g
tetrahydrofuran: 100 g The thus obtained elect photographic sensitive material was then electrified by 20 seconds' coronea discharge of −6.0 KV, left standing in a dark place for 20 seconds thereafter and measured about the surface potential $V_{po}$(V) thereat. Subsequently, the amount of exposure $E_{\frac{1}{2}}$ (lux.sec.) required for half decay of $V_{po}$ after application of the light of a 20-lux white tungsten lamp was measured. The result was as follows:

$V_{po}$=1250 V, $E_{\frac{1}{2}}$=4.0 lux.sec.

Next, when an electrostatic latent image was formed by effecting electrification and image-like exposure by the known method, the thus formed latent image was subjected to dry-developing or wet-developing, and the resulting toner image was electrostatically transferred onto a slick paper and fixed thereon, there was obtained a positive image free of stains on the ground thereof and faithful to the original.

EXAMPLE 4

By applying the same procedure as in Example 3 except for employing a liquid according to the following prescription to form the layer C and making the dry thickness of the layer C and layer D 2μ and 10.5μ, respectively, a laminate-type electrophotographic sensitive material was prepared.

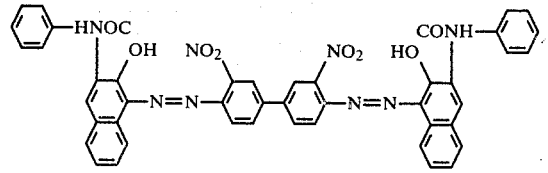

| | |
|---|---|
| (azo pigment) | 1 g |
| 2,4,8-trinitrothioxantone | 1 g |
| polycarbonate resin (namely, PANLITE L, the manufacture of K.K. TEIJIN) | 1 g |

-continued

| | |
|---|---|
| tetrahydrofuran | 100 g |

When measurement of $V_{po}$ and $E_{\frac{1}{2}}$ was conducted subsequently by the same method as in Example 3, the result was $V_{po}=1300$ V and $E_{\frac{1}{2}}=3.0$ lux.sec. Further, when this photosensitive material was used in copying through the same procedure as in Example 3, the result was as satisfactory as in Example 3.

EXAMPLE 5

By applying the same procedure as in Example 3 except for employing a liquid according to the following prescription to form the layer C and making the dry thickness of the layer C and layer D 2μ and 10.5μ, respectively, a laminate-type electrophotographic sensitive material was prepared.

azo pigment Dian Blue (C.I. No. 21180) 1 g
2,4,5,7-tetranitro-9-fluorenone: 1 g
polyester resin (the same as in Example 1): 1 g
tetrahydrofuran: 100 g When measurement of $V_{po}$ and $E_{\frac{1}{2}}$ was conducted subsequently by the same method as in Example 3, the result was $V_{po}=1200$ V and $E_{\frac{1}{2}}=3.5$ lux.sec. Further, when this photosensitive material was used in copying through the same procedure as in Example 3, the result was as satisfactory as in Example 3.

EXAMPLE 6

By applying the same procedure as in Example 3 except for employing a liquid according to the following prescription to form the layer C and layer D, respectively, and making the dry thickness of the layer C and layer D 2μ and 9.5μ, respectively. a laminate-type electrophotographic sensitive material was prepared.

Liquid for forming layer C:

B-type copper phthalocyanine (the same as in Example 7): 1 g
2,6,8-trinitro-4H-indeno[1,2-b]thiophene-4-on: 1 g
polyester resin (the same as in Example 1): 1 g
tetrahydrofuran: 100 g Liquid for forming layer D:

3-nitropyrene-formaldehyde condensate: 10 g
polyester resin (the same as in Example 1): 1 g
tetrahydrofuran: 100 g When measurement of $V_{po}$ and $E_{\frac{1}{2}}$ was conducted subsequently by the same method as in Example 7, the result was $V_{po}=1050$ V and $E_{\frac{1}{2}}=3.5$ lux.sec. Further, when this photosensitive material was used in copying through the same procedure as in Example 3, the result was as satisfactory as in Example 3.

EXAMPLE 7

By applying the same procedure as in Example 3 exept for employing a liquid according to the following prescription to form the layer C, a laminate type electrophotographic sensitive material was prepared.

Liquid for forming layer C:

Dian Blue (azo pigment, C.I. No. 21180): 0.1 g
1,3,7-trinitrophenetidine oxide: 1 g
polyester resin (Polyester Adhesive 4900 manufactured by DuPont Inc.): 1 g
tetrahydrofuran: 100 g When measurement of $V_{po}$ and $E_{\frac{1}{2}}$ was conducted subsequently by the same method as in Example 3, the result was $V_{po}=980$ V and $E_{\frac{1}{2}}=3.5$ lux.sec.

EXAMPLE 8

By applying the same procedure as in Example 3 except for employing a liquid according to the following prescription to form the layer C, a laminate type electrophotographic sensitive material was prepared.

Liquid for forming layer C:

perylene pigment (C.I. No. 71135): 0.1 g
2,4,10-trinitrobenzo[C]cinnoline-6-oxide: 1 g
polyester resin: 1 g
tetrahydrofuran: 100 g When measurement of $V_{po}$ and $E_{\frac{1}{2}}$ was conducted according to the same method as in Example 3 the result was $V_{po}=1000$ V and $E_{\frac{1}{2}}=4.0$ lux.sec.

What is claimed is:

1. An electrophotographic element, which comprises: an electrically conductive support; a first layer overlying said support, the electrophotographically active constituents of said first layer consisting essentially of (1) a photoconductive substance capable of generating conductive charge carriers through light absorption and (2) either an electron donor or an electron acceptor, the weight ratio of (1) said photoconductive substance to (2) said electron donor or said electron acceptor being from 1/10 to 1/0.1, said photoconductive substance being selected from the group consisting of Se, Se alloy, CdS, CdSe, ZnO, ZnS, TiO, phthalocyanine pigment, azo pigment, indigo pigment, perylene pigment and polycyclic quinone pigment, said electron donor being selected from the group consisting of poly-N-vinyl carbazole and derivatives thereof, poly-γ-carbazolyl ethyl glutamate and derivatives thereof, pyrene-formaldehyde condensate and derivatives thereof, anthracene-formaldehyde condensate, N-ethyl carbazole-formaldehyde condensate, polyphenylene pyrazole, poly-1-allyl-4,5-diphenyl imidazole, polyvinyl pyrene, polyvinyl phenanthrene, polyacenaphthylene, polyvinyl dibenzothiophene, polyvinyl anthracene, oxazole, oxadiazole, pyrazole, imidazole derivatives, anthracene, tetraphene and pyrene, and said electron acceptor being selected from the group consisting of fluorenone derivatives, dibenzothiophene derivatives, indenothiophene derivatives, phenanthrene quinone derivatives, indenopyridine derivatives, thioxanthone derivatives, benzo cinnoline derivatives, phenazine oxide derivatives, tetracyanoethylene, tetracyanoquinodimethane, bromanil, chloranil, benzoquinone, naphthoquinone, anthraquinone derivatives, phthalic anhydride, picric acid, trichloroacetic acid, tetrabromonaphthoquinone, 1,5-dinitronaphthalene, 2,4,5,7-tetranitrofluorenone, 1,4-dibromonaphthalene, pyrene-3-aldehyde and 9-acetylanthracene; and a second layer overlying and adjacent to said first layer, the electrophotographically active constituent of said second layer consisting essentially of said electron donor or said electron acceptor, with the proviso that when said first layer contains said electron donor said second layer contains said electron acceptor and when said first layer contains said electron acceptor said second layer contains said electron donor, and neither of said first layer and said second layer contains both an electron donor and an electron acceptor.

2. An electrophotographic element according to claim 1, wherein said first layer contains an electron donor and said second layer contains an electron acceptor.

3. An electrophotographic element according to claim 1, wherein said first layer contains an electron acceptor and said second layer contains an electron donor.

4. An electrophotographic element according to claim 1, wherein the balance of said first layer consists essentially of a resinous binder and/or a plasticizer in an amount of less than 200 wt. %, based on the weight of said photoconductor substance and said electron donor or acceptor present in said first layer.

5. An electrophotographic element according to claim 4, wherein the balance of said second layer consists essentially of a resinous binder and/or a plasticizer in an amount of less than 200 wt. %, based on the weight of said electron donor or acceptor present in said second layer.

6. An electrophotographic element according to claim 1, wherein a layer of resin or a layer of metal oxide having a thickness in the range of 0.01–1.0μ is provided between said first layer and said conductive support.

7. An electrophotographic element according to claim 1, in which said first layer and said second layer are in direct surface-to-surface contact and the electron donor and the electron acceptor contained in the respective layers form a charge-transport complex at the interface between said layers.

8. An electrophotographic element according to claim 7, in which said second layer is formed on said first layer by applying a solution or dispersion containing a solvent for the electron acceptor or electron donor contained in said first layer.

9. An electrophotographic element according to claim 1, in which the thickness of said first layer is from 0.05 to 20 microns and the thickness of said second layer is from 5 to 100 microns.

* * * * *

UNITED STATES PATENT AND TRADEMARK OFFICE

CERTIFICATE OF CORRECTION

PATENT NO. : 4 264 695

DATED : April 28, 1981

INVENTOR(S) : Akio Kozima et al

It is certified that error appears in the above—identified patent and that said Letters Patent is hereby corrected as shown below:

On the title page and immediately below "Aug. 23, 1976 [JP] Japan ..... 51-100369" insert the following:

---Aug. 25, 1976 [JP] Japan ..... 51-101461---.

Column 8, line 45; change "benzo cinnoline" to ---benzo[C]cinnoline---.

Column 8, line 50; change "2,4,5,7-tetranitrofluorenone" to ---2,4,5-7-tetranitrofluorenone---.

Column 9, line 7; change "photoconductor" to ---photoconductive---.

Signed and Sealed this

*Twentieth* Day of *April 1982*

[SEAL]

*Attest:*

*Attesting Officer*

GERALD J. MOSSINGHOFF

*Commissioner of Patents and Trademarks*